United States Patent [19]

Zakai

[11] Patent Number: 4,944,456

[45] Date of Patent: Jul. 31, 1990

[54] ROTARY SPRINKLER

[75] Inventor: Avi Zakai, Rishon Le-Zion, Israel

[73] Assignee: Dan Mamtirim, Galil Elyon, Israel

[21] Appl. No.: 343,700

[22] Filed: Apr. 27, 1989

[30] Foreign Application Priority Data

Apr. 29, 1988 [IL] Israel ..... 86226

[51] Int. Cl.[5] ..... B05B 3/04

[52] U.S. Cl. ..... 239/222.19; 239/240; 239/DIG. 1

[58] Field of Search ..... 239/222, 222.11, 222.17, 239/222.19, 206, 232, 237, 240, 263, 380, 381, DIG. 1

[56] References Cited

U.S. PATENT DOCUMENTS

| | | | |
|---|---|---|---|
| 3,334,817 | 8/1967 | Miller et al. | 239/206 |
| 4,754,925 | 7/1988 | Rubinstein | 239/381 |
| 4,784,325 | 11/1988 | Walker et al. | 239/204 |
| 4,842,201 | 6/1989 | Hunter | 239/240 |

*Primary Examiner*—Andres Kashnikow
*Assistant Examiner*—Karen B. Merritt
*Attorney, Agent, or Firm*—Browdy and Neimark

[57] ABSTRACT

A rotary sprinkler having a base member for coupling to an irrigation supply and formed with one or more base member outlets, there being furthermore provided a rotary distributor member of substantially cuspidal shape rotatably mounted with respect to said base member with an apical end thereof adjacent the base member and an opposite broad end thereof remote from the base member, a plurality of distributor passages are formed in a curved surface of the distributor member, each passage extending from a passage inlet located in said apical end adjacent to a base member outlet to a passage outlet located in said broad end, a rotary turbine member is rotatably mounted with respect to the distribution member and provided with a plurality of turbine blades disposed adjacent the passage outlets so that irrigation streams emerging from the passage outlets strike said blades and rotatably displace the turbine member, ball drive means being located between the turbine and distributor members for transmitting the rotary displacement of the turbine member to the distributor member.

5 Claims, 2 Drawing Sheets

ROTARY SPRINKLER

FIELD OF THE INVENTION

This invention relates to a rotary sprinkler and filter assemblies for use therewith.

BACKGROUND OF THE INVENTION

Rotary sprinklers have long been known and various designs have been proposed and used involving differing means for ensuring the rotation of the sprinkler. Among these means are known sprinklers wherein rotation is ensured by the provision of rotary turbine members driven by the emitted spray.

BRIEF SUMMARY OF THE INVENTION

It is an object of the Present invention to provide a new and improved rotary sprinkler. particularly but not exclusively for use in pop-up sprinklers, as well as to provide new contructions of filter assemblys for use with rotary sprinklers.

According to the present invention there is provided a rotary sprinkler comprising:

a base member for coupling to an irrigation supply and formed with one or more base member outlets;

a rotary distributor member of substantially cuspidal shape rotatably mounted with respect to the base member with an apical end thereof adjacent the base member and an opposite broad end thereof remote from the base member;

a plurality of distributor passages formed in a curved surface of the distributor member, each passage extending from a passage inlet located in said apical end adjacent to a base member outlet to a passage outlet located in said broad end;

a rotary turbine member rotatably mounted with respect to said distributor member and provided with a plurality of turbine blades disposed adjacent to said passage outlets so that irrigation streams emerging from said passage outlets strike said blades and rotatably displace the turbine member; and a ball drive means located between said turbine and distributor members for transmitting the rotary displacement of the turbine member to the distributor member.

Thus, with such a rotary sprinkler in accordance with the invention, water emerging from the base member outlets passes through the distributor passages so as to strike the turbine blades imparting a rotary movement to the turbine blades which rotary movement is transmitted by the ball drive means to the distributor member. In this way, a rotary sprinkling effect is obtained. Depending on the angular distribution of the base member outlets, irrigation can be effected covering areas entirely surrounding the rotary sprinkler to areas covering a relatively small angle subtended by the rotary sprinkler.

Preferably, the rotary sprinkler in accordance with the invention is incorporated in a pop-up sprinkler.

In accordance with an embodiment of the present invention there is provided,a pop-up sprinkler of a kind wherein a sprinkler head is screw fitted to a tubular element and is displaceable into and out of a casing, irrigation supply pressure serving to displace the sprinkler head out of the casing against an oppositely directed spring bias;

a tubular filter assembly located in an upstream portion of said tubular element;

successive downstream and upstream inner wall portions of the tubular element, the downstream wall portion being of greater internal diameter than the upstream wall portion;

a base portion of said filter assembly of smaller diameter than that of the downstream wall portion and being substantially equal to that of the upstream wall portion;

a first retaining means for releasably retaining the filter assembly in the tubular element with the base portion adjacent said downstream wall portion; and second retaining means for retaining the filter assembly in said tubular element with said base portion displaced into a position adjacent the upstream wall portion under the influence of irrigation supply pressure and after release from said first retaining means.

Thus, with a filter assembly construction and mode of mounting in accordance with the present invention, it is possible to service the filter assembly, for example remove it for cleaning or replacement, during operation of the pop-up sprinkler in which the filter assembly is fitted and without having to turn off the irrigation water supply. All that is necessary is to release the first retaining means, whereupon the filter assembly is pushed upwardly under the existing water pressure until the base element thereof makes substantially sealing contact with the inner wall surface of the tubular element and in this way the flow of water through the filter assembly is interrupted, allowing for the ready removal of the filter assembly.

BRIEF DESCRIPTION OF THE DRAWINGS

FIG. 4 is a longitudinal sectional view of a pop-up sprinkler incorporating a rotary sprinkler as shown in FIGS. 2 and 3.

DETAILED DESCRIPTION OF PREFERRED EMBODIMENT

Figure 1:
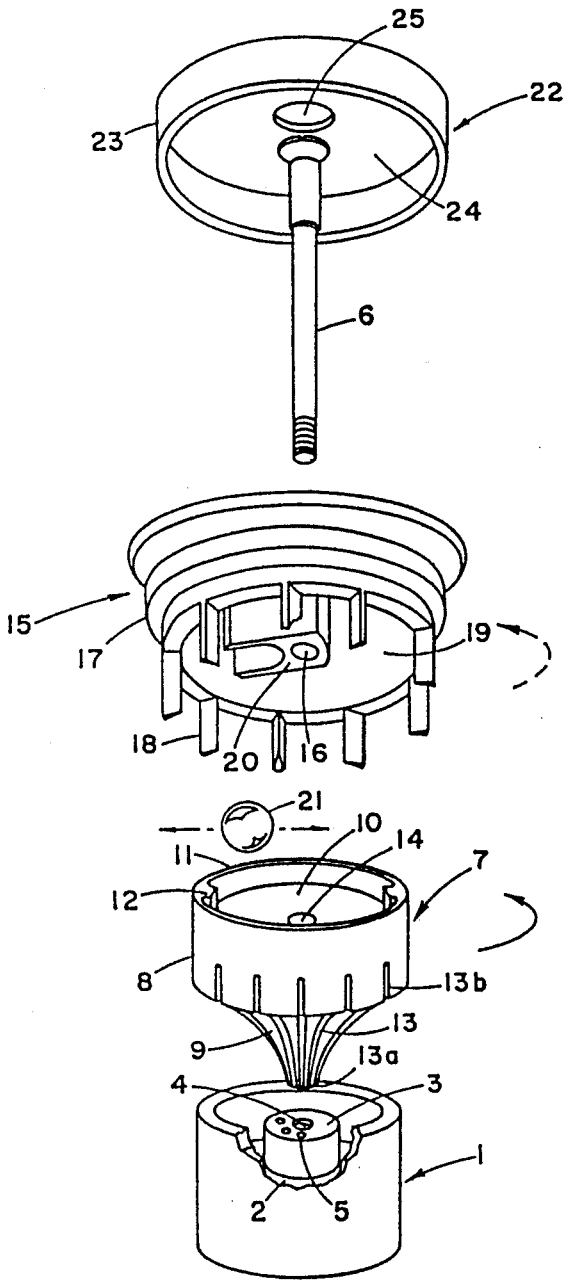
FIG. 1 is an exploded view of a rotary sprinkler in accordance with the present invention.

As seen in the drawings, the rotary sprinkler comprises a base member 1 adapted to be fixedly mounted on an irrigation riser (not shown). Extending centrally out of a transverse wall 2 of the base member 1 is a boss 3 which is formed with a central tapped recess 4 and a plurality of peripheral through-going bores 5 which communicate with the interior of the base member 1. A central axle pin 6 is formed with a lower threaded end adapted to be screw coupled into the tapped aperture 4.

A rotary distributor member 7 is formed with a cylindrical body portion 8 from which downwardly depends a conical portion 9 of substantially cuspidal shape having concave walls. The cylindrical body portion 8 is formed with an inner base 10 surrounded by a peripheral wall 11 formed integrally with the outer surface of the body portion 8 and having formed integrally therewith a pair of inwardly directed abutments 12. Formed in the outer wall of the conical portion 9 and equiangularly displaced thereon is a plurality of distribution grooves 13, each groove 13 extending from a groove inlet **13*a* located adjacent the lower tip of the conical portion 9 to a groove outlet 13*b* formed in the cylindrical body member 8. The distributor member 7 is formed with a central through-going bore 14 through which extends the pin 6**.

A rotary turbine member 15 having a central throughgoing bore 16 is formed with a stepped peripheral wall 17 from which depends downwardly a plurality of equiangularly distributed, angularly disposed blades 18. The base wall 19 (of the turbine member 15) defines together with the inner base 10 and the peripheral wall 11 (both of the d istributor member 7) a ball drive chamber 19*a*. Formed integrally with a base wall 19 of the turbine member 15 and within the confines of the peripheral wall 17 is a ball guide member 20 which is so dimensioned that a ball 21 located in guide 20 is capable of limited lateral displacement within the ball drive chamber 19*a* and when in continuous contact with the base 19 between the inner surface of the peripheral wall 17 and the inner extremity of the guide 20.

A cylindrical cover cap 22 is formed with a peripheral cylindrical wall 23 and has formed in an end surface 24 thereof a central aperture 25 through which passes the axle pin 6.

Figure 2:
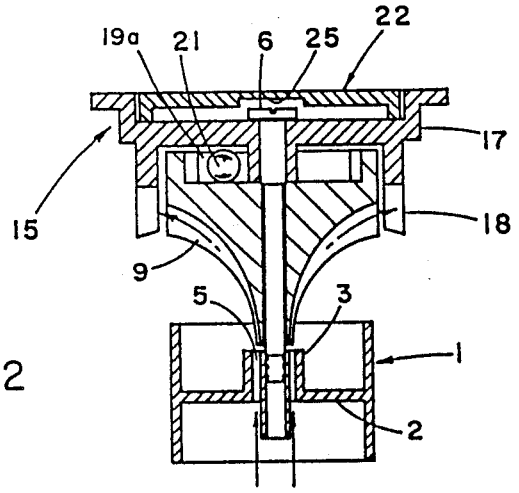
FIG. 2 is a longitudinally sectioned view of the assembled sprinkler.

When the component elements of the rotary sprinkler just described with reference to FIG. 1 of the drawings are assembled together by being mounted, in the correct order, on the axle pin 6 then, as can be seen in FIGS. 2. 3 and 4 of the drawings, the rim of the cap 22 fits into the upper end of the turbine member 15 fits into the top cap 22, whilst the upper end of the peripheral wall 11 fits into the cylindrical body member 17 so that the ball 21 is effectively trapped within the ball guide 20 and the inner surface of the peripheral wall 17.

With the rotary sprinkler so assembled, water flowing from the irrigation riser into the base cap 1 follows a flow path which emerges from the apertures 5 and flows via the adjacently disposed inlets 13*a* through the grooves 13 so as to emerge as discrete sprays 26 from the outlets 13*b*. The emerging sprays strike the turbine blades 18 causing the turbine 15 to rotate. The rotation of the turbine 15 causes the ball 21 to move outwardly so as to be pressed against the inner surface of the peripheral wall 17. In this position, the continued rotation of the turbine member 15 causes the ball 21 to bear against one or other of the abutments 12 and this results in the rotation of the distributor member 7. This rotation results in the discrete emerging sprays 26 being uniformly distributed over the irrigation area. The movement of the ball 21 in the ball drive chamber 19*a* takes place freely seeing that the chamber 19*a* is outside the water flow path and is therefore not likely to become filled with water which could impede the ball movement.

The distribution of the apertures 5 determines the limits of the area to be irrigated. Thus, it will be readily appreciated that if the apertures 5 are uniformly distributed around the boss 3 an area extending up to 360° with reference to the rotary sprinkler will be irrigated. If, however, as shown in the drawings, the apertures 5 are restricted to a particular portion of the boss, a correspondingly restricted area will be irrigated. It will be readily appreciated that with a boss 3 having apertures 5 uniformly distributed around it, differing areas can be irrigated by selectively blocking off some of the apertures, leaving others open. Preferably, the apertures are so distributed with respect to the boss 3 as to define an angle not greater than 180° with respect to the central axis of the rotary sprinkler.

Figure 3:
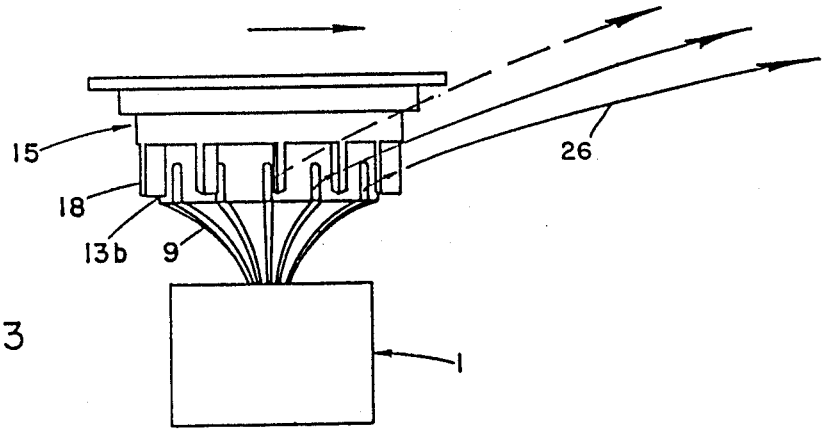
FIG. 3 is a side elevation of the sprinkler in operation.

Referring to FIG. 4 of the drawings, there is here shown a pop-up sprinkler incorporating a rotary sprinkler of the kind just described with reference to FIGS. 1 to 3 of the drawings. An outer sprinkler casing 35 is adapted for coupling to an irrigation riser (not shown) and is formed integrally with a cylindrical sprinkler cover member 36 which surrounds the rotary sprinkler. Secured to the cover member 36 is an annular sealing member 37 having an inner lip 38 which bears against an upper end of the cylindrical base member 1.

An inner tubular casing 41 is axially displacable within the outer fixed casing 35 and is formed with a pair of axially spaced apart laterally disposed shoulders 42 and 43, a tubular compression spring 44 being located between the casings 41 and 35 and bearing at its lower end against an inner surface of the shoulder 42 and at its upper end against a bearing disc 46 formed integrally with an under surface of an annular inwardly directed flange of the cover 36. Thus, the effect of the compression spring 44 is to bias the inner casing 41 downwardly into the outer fixed casing 35.

The inner tubular surface of the inner casing 41 has got an upper portion 47*a* which is of reduced internal diameter as compared with a lower portion 47*b*.

An upper, slightly inset threaded end of the upper portion 47*a* is screw fitted to correspondingly tapped lower portion of the base member 1.

Formed integrally with an inner surface of the upper portion 47*a* is an inwardly directed retaining flange 48.

Located within the tubular casing 41 and adjacent the upper portion thereof 47*a* is a tubular filter assembly 51 which comprises a disc-like base member 52 of an external diameter less than the internal diameter of the lower portion 47*b* and substantially equal to the internal diameter of the upper portion 47*a*. A tubular filter assembly 53 is secured at its lower end to the base member 52 and, at its upper end, to a collar 54 formed with an outwardly directed retaining flange 55 of external diameter greater than the internal diameter of the retaining flange 48.

In use, and with the rotary sprinkler assembled as shown in FIG. 4 of the drawings, water flowing into the casing bears on the flanges 43 and 42, thereby forcing the inner casing 41 upwardly against the biasing effect of the spring 44 and in this way the rotary sprinkler 31 is also displaced upwardly and is uncovered for sprinkler action. The action of the water on the base member 52 of the filter assembly 51 cannot however displace the latter axially upwards from the Position shown in FIG. 4 of the drawings, seeing that the upper edge of the collar 54 bears against the transverse wall 2 of the base member 1. Water can enter the filter assembly via the space between the base 52 and the inner surface of the portion 47*b*, passing through the tubular filter 53 so as to emerge therefrom into the boss 3 and out of the boss into the rotary sprinkler for rotary sprinkling.

When, however, it is desired to service the filter assembly 51 without having to turn off the irrigation water supply and with the inner casing 41 and the rotary sprinkler 31 in the upper elevated condition, the base member 1 is unscrewed. The tubular element 51 is thereupon pushed upwardly under the existing water pressure so that the outer edge of the base member 52 makes substantially sealing contact with the inner tubular surface of the upper portion 47*a* and abuts a retaining flange 47*c* and in this way the flow of water through the filter assembly is interrupted. With the filter assembly thus fully displaced upwardly, it can be readily serviced, for example cleaned or replaced.

Whilst in the embodiment described above with reference to FIG. 4 of the drawings the novel construction and mounting of the filter assembly has been described with reference to a pop-up sprinkler incorporating a rotary sprinkler in accordance with the invention, the novel construction and mounting of the filter assembly can be incorporated in sprinklers of all other kinds.

I claim:

1. A rotary sprinkler comprising:

a base member for coupling to an irrigation supply and formed with a plurality of base member outlets;

a rotary distributor member of substantially cuspidal shape rotatably mounted with respect to said base member with an apical end thereof adjacent the base member and an opposite broad end thereof remote from the base member;

a plurality of distributor passages formed in a curved surface of the distributor member, each passage extending from a passage inlet located in said apical end adjacent to a base member outlet to a passage outlet located in said broad end;

a rotary turbine member rotatably mounted with respect to said distribution member and provided with a plurality of turbine blades disposed adjacent said passage outlets so that irrigation streams emerging from said passage outlets strike said blades and rotatably displace the turbine member;

a water flow path extending through said sprinkler from said base member outlets to said passage outlets;

a ball drive chamber defined by adjacent portions of said turbine and distributor members and outside said water flow path; and a ball drive means located in said ball drive chamber for transmitting the rotary displacement of the turbine member to the distributor member.

2. A rotary sprinkler according to claim 1 wherein said base member outlets are constituted by discrete outlets equiangularly distributed about said base member.

3. A rotary sprinkler according to claim 2 wherein said outlets define an angle of less than 180° with respect to a central axis of the base member.

4. A pop-up sprinkler incorporating a rotary sprinkler according to claim 1 and which is screw fitted to a tubular element and is displaceable into and out of a casing, irrigation supply pressure serving to displace the sprinkler head out of the casing against an oppositely directed spring bias.

5. For use in a pop-up sprinkler according to claim 4, a tubular filter assembly located in an upstream position of said tubular element;

successive downstream and upstream inner wall portions of said tubular element, the downstream wall portion being of greater internal diameter than the upstream wall portion;

a base portion of said filter assembly of smaller diameter than that of the downstream wall portion and being substantially equal to that of the upstream wall portion;

a first retaining means for releasably retaining the filter assembly in said tubular element with said base portion adjacent said downstream wall portion; and second retaining means for retaining the filter assembly in said tubular element with said base portion displaced into a position adjacent said upstream wall portion under the influence of irrigation supply pressure and after release from said first retaining means.

* * * * *